US007637975B2

(12) United States Patent
Stein et al.

(10) Patent No.: US 7,637,975 B2
(45) Date of Patent: Dec. 29, 2009

(54) FILTER BAG ARRANGEMENT FOR A VACUUM CLEANER

(75) Inventors: Thomas Stein, Velbert (DE); Bernd Falkenstein, Wuppertal (DE)

(73) Assignee: Stein & Co. GmbH, Velbert (DE)

( * ) Notice: Subject to any disclaimer, the term of this patent is extended or adjusted under 35 U.S.C. 154(b) by 489 days.

(21) Appl. No.: 11/234,501

(22) Filed: Sep. 23, 2005

(65) Prior Publication Data

US 2006/0064951 A1 Mar. 30, 2006

(30) Foreign Application Priority Data

Sep. 24, 2004 (DE) ..... 10 2004 046 384

(51) Int. Cl.
*B01D 46/00* (2006.01)

(52) U.S. Cl. ..... 55/373; 55/341.7; 55/369; 55/371; 55/378; 55/DIG. 2

(58) Field of Classification Search ..... 55/341.7, 55/369, 371, 372, 378, 373, 381, 362, DIG. 2, 55/DIG. 3, DIG. 26; 15/327
See application file for complete search history.

(56) References Cited

U.S. PATENT DOCUMENTS 2,028,090 A * 1/1936 Frantz ..... 15/351
3,883,030 A * 5/1975 Mathews et al. ..... 220/203.16
5,028,245 A * 7/1991 Stein et al. ..... 55/373
6,328,527 B1 * 12/2001 Conrad et al. ..... 415/90
6,637,608 B1 * 10/2003 Schneider ..... 211/90.02
2004/0163205 A1 * 8/2004 Albert et al. ..... 15/352
2004/0187251 A1 * 9/2004 Schwarz et al. ..... 15/327.2

FOREIGN PATENT DOCUMENTS

EP 0 396 864 1/1993
EP 0997098 * 3/2000

* cited by examiner

*Primary Examiner*—Michael A Marcheschi
*Assistant Examiner*—Karla Hawkins
(74) *Attorney, Agent, or Firm*—W. F. Fasse; W. G. Fasse

(57) ABSTRACT

A filter bag arrangement for a vacuum cleaner includes a bag body of filter material, and a stiffening element in the form of a filter mounting plate with an inlet opening of the bag therein. The vacuum cleaner includes a housing defining a chamber into which the bag may be inserted, a lid to cover the chamber, and a filling pipe stub that is insertable into the inlet opening. Plural individual mounting elements are provided at the outer edge of the stiffening element and are inserted into corresponding individual receivers of the housing so as to spatially position and fix the inlet opening of the filter bag arrangement relative to the housing of the vacuum cleaner.

20 Claims, 2 Drawing Sheets

FILTER BAG ARRANGEMENT FOR A VACUUM CLEANER

PRIORITY CLAIM

This application is based on and claims the priority under 35 U.S.C. §119 of German Patent Application 10 2004 046 384.0, filed on Sep. 24, 2004, the entire disclosure of which is incorporated herein by reference.

FIELD OF THE INVENTION

The invention relates to an arrangement for positioning and securing a filter bag in a vacuum cleaner housing.

BACKGROUND INFORMATION

It is conventionally known to provide a vacuum cleaner filter bag with a stiffening element in the form of a filter mounting or securing plate, as well as a filling hole or inlet opening through which the dust-laden air flows into the filter bag through a filling pipe stub from a vacuum hose. In this regard, the filling pipe stub of the vacuum cleaner housing or lid must be inserted into the inlet opening of the filter bag. It is thus necessary to ensure that the filter bag is properly positioned in the vacuum cleaner housing, so that the filling pipe stub can be inserted into the inlet opening of the filter bag without problems.

The European Patent Publication EP 396 864 B1 has disclosed an arrangement for mounting and securing a vacuum cleaner filter bag in a vacuum cleaner housing, in a manner so as to allocate and align the filling pipe stub to the inlet opening of the filter bag without problems, and thereby to ensure the smooth and proper functioning of the filter bag and its connection to the filling pipe stub. Particularly, the disclosed arrangement aims to avoid installation errors of the filter bag, such as a misalignment of the filling pipe stub and the inlet opening of the bag. However, this known arrangement is relatively complicated and therefore costly, and comprises a relatively large number of individual elements. A simpler and more economical arrangement of a filter bag in this regard would be advantageous.

SUMMARY OF THE INVENTION

In view of the above, it is an object of the invention to improve conventional filter bag arrangements and particularly to provide a simple arrangement by which the inlet opening of the filter bag can be properly positioned and spatially fixed in the bag-receiving chamber of the vacuum cleaner housing. It is a further object of the invention to ensure a precise, consistent and unambiguous allocation and alignment of the filling pipe stub of the vacuum cleaner to the inlet opening of the filter bag. The invention further aims to avoid or overcome the disadvantages of the prior art, and to achieve additional advantages, as apparent from the present specification. The attainment of these objects is, however, not a required limitation of the claimed invention.

The above objects have been achieved according to the invention in a vacuum cleaner including a vacuum cleaner housing defining a bag-receiving space or chamber therein, a housing cover or lid that can be selectively closed and opened to respectively cover and uncover the bag-receiving chamber, and a filter bag arrangement removably arranged in the chamber. The filter bag arrangement includes a filter bag body of filter material, a stiffening element in the form of a filter mounting or securing plate provided on the filter bag body, and a filling hole or inlet opening that opens into the filter bag body. The stiffening element can be removably inserted into a corresponding receiver arrangement of the vacuum cleaner housing. A filling pipe stub connected to the lid or the housing of the vacuum cleaner is inserted or engaged into the inlet opening of the filter bag, for example upon closing the lid.

Especially according to the invention, the perimeter or edge region of the stiffening element comprises a plurality of individual mounting elements that are individually insertable and engageable into corresponding allocated receivers of the vacuum cleaner housing, substantially in the direction of inserting the filter bag into the bag-receiving chamber of the vacuum cleaner housing (e.g. vertically). By means of the insertion and engagement of the individual mounting elements into the allocated individual receivers of the housing, the inlet opening of the filter bag is spatially positioned and secured in the bag-receiving chamber. Particularly, the inlet opening is properly positioned to smoothly receive the filling pipe stub inserted therein, for example as the housing lid or cover of the vacuum cleaner is closed.

With this simple arrangement involving only simple individual mounting elements being engaged into corresponding receivers of the housing while the filter bag is inserted into the bag-receiving chamber, the bag stiffening element is unambiguously and unmistakably properly positioned and secured with respect to the vacuum cleaner housing. This ensures that the inlet opening of the bag is properly positioned to cooperate with the filling pipe stub.

A further detailed embodiment feature of the invention advantageously provides a seal, e.g. a seal ring, in the inlet opening in the stiffening element of the filter bag, to achieve a good seal relative to the filling pipe stub.

Further preferably according to the invention, at least three individual mounting elements, or particularly four in an X-configuration, are provided on the bag stiffening element. A relatively simple structure and fixing of the mounting elements are achieved if the individual mounting elements are at least partially formed respectively by hemispheres or half-dome protrusions.

A further advantageous feature of the invention is that the stiffening element can be removably connected to the filter bag body of filter material. Thereby, the filter bag body can be exchanged or replaced separately from the stiffening element, and vice versa.

Another beneficial feature of the inventive arrangement is the provision of a closure cap that is permanently connected (to prevent loss thereof) by a connecting strap to the stiffening element. This closure cap can be used selectively to close the inlet opening when the filter bag is full of dust, dirt or other debris and is to be removed from the vacuum cleaner chamber for replacement. Thereby, the closure cap prevents dust, dirt or the like from leaking out of the inlet opening of the filter bag when the bag is removed from the vacuum cleaner.

It is further preferred and advantageous that the stiffening element shall remain fixed with respect to the vacuum cleaner housing when the user of the vacuum cleaner opens the lid or cover and thereby removes the filling pipe stub from the inlet opening of the filter bag. For this purpose, the filter bag preferably further comprises a latching strap that is flexible or at least flexibly or pivotably connected to the stiffening element and protrudes radially outwardly relative to the inlet opening. This strap may be tilted, bent, pivoted or deflected so as to engage a corresponding securing element of the vacuum cleaner housing, whereby this latching strap is securely held or fixed. Furthermore, the latching strap can be provided with a latching protrusion, lip, rim, offset, or the like, for example on the side thereof facing toward the filter bag body from the stiffening element. This latching protrusion can extend in a tangential direction near the free end of the latching strap. When the latching strap is pivoted or otherwise deflected, this latching protrusion presents an undercut, rim or groove, that engages with the corresponding securing element provided on the vacuum cleaner housing.

The pivoting or other deflection of the latching strap is preferably caused by an edge zone or rim of the lid or cover of the vacuum cleaner housing pressing against and deflecting the latching strap as the cover is closed. Thereby, the securing element, embodied as a flexible element, is pressed by the latching strap and deflected from a first position in which it would block further closing of the cover to a second position in which it secures the latching strap.

BRIEF DESCRIPTION OF THE DRAWINGS

In order that the invention may be clearly understood, it will now be described in connection with example embodiments thereof, with reference to the accompanying drawings, wherein.

Figure 1:
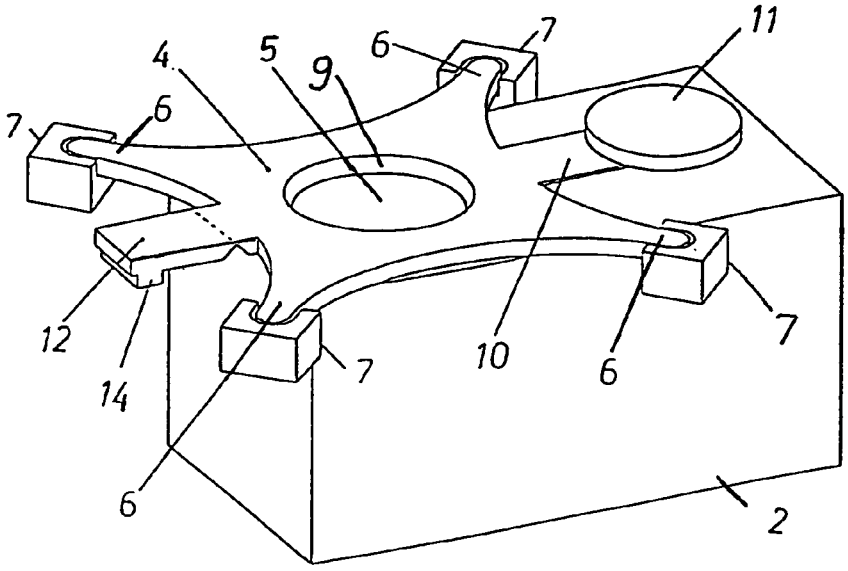
FIG. 1 is a schematic perspective view of a first embodiment of a filter bag arrangement for a vacuum cleaner, also showing individual receivers of the vacuum cleaner.

DETAILED DESCRIPTION OF PREFERRED EXAMPLE EMBODIMENTS AND OF THE BEST MODE OF THE INVENTION

A vacuum cleaner housing 1 defines a bag-receiving cavity or chamber therein, in which an exchangeable filter bag arrangement 2 is to be arranged, i.e. received and secured. The vacuum cleaner further includes a cover or lid 3 that is tiltably or pivotally connected to the housing 1 so as to selectively cover or uncover the bag-receiving chamber in the housing 1.

The overall filter bag arrangement 2 includes a filter bag body of air-permeable filter material which may be flexible and flaccid, or rigid and self supporting, and may be constructed with or without a frame. Any conventionally known or future developed configuration, construction and filter material can be used for the filter bag body of the filter bag arrangement 2. The filter bag arrangement 2 further comprises a stiffening element 4 in the form of a filter mounting or securing plate, through which a filling hole or inlet opening 5 communicates into the interior of the filter bag arrangement 2. The stiffening element 4 may be made of cardboard, plastic, pressboard, hardboard, composite material, metal, or any other suitable material.

A perimeter or outer edge region of the stiffening element 4 of the filter bag arrangement 2 comprises a plurality of individual mounting elements 6 that are configured and arranged so that they can be inserted into respective allocated individual receivers 7 of the vacuum cleaner housing 1. Particularly, the individual mounting elements 6 are inserted into the individual receivers 7 in the same direction of inserting the filter bag arrangement 2 into the bag-receiving cavity, e.g. vertically in the present example. This insertion and engagement of the individual mounting elements 6 into the individual receivers 7 spatially positions and fixes the inlet opening 5 of the filter bag arrangement 2 relative to the housing 1, so that a filling pipe stub 8 preferably provided on the housing cover or lid 3 is smoothly inserted into the inlet opening 5 as the cover or lid 3 is tilted downward into its closed position. Also, a seal 9 is preferably provided around the perimeter of the inlet opening 5 in the stiffening element 4 to achieve a good seal of the filling pipe stub 8 inserted into the inlet opening 5.

In the example embodiment according to FIG. 1, the individual mounting elements 6 are configured as spokes, spider arms, or outrigger arms protruding outwardly from the body of the stiffening element 4. These spokes or arms 6 particularly preferably extend radially outwardly from the inlet opening 5. The radially outer ends of the spokes or arms of the individual mounting elements 6 are insertable into the individual receivers 7 in the form of notches, recesses, grooves, or sockets in the vacuum cleaner housing 1. Note that FIG. 1 shows portions of the vacuum cleaner housing 1 forming the individual receivers 7. Thereby, the stiffening element 4 and particularly the inlet opening 5 therein is precisely positioned, stabilized, and fixed in space relative to the vacuum cleaner housing 1.

The filter bag arrangement 2 further comprises a closure cap 11 for the inlet opening 5, whereby this cap 11 is connected to the stiffening element 4 by a flexible or pivotable connecting strap 10. The closure cap 11 can be plugged into or otherwise engaged with the inlet opening 5 so as to close the opening 5 to prevent the leakage of dust or the like when the full filter bag is to be removed and exchanged.

Figure 2:
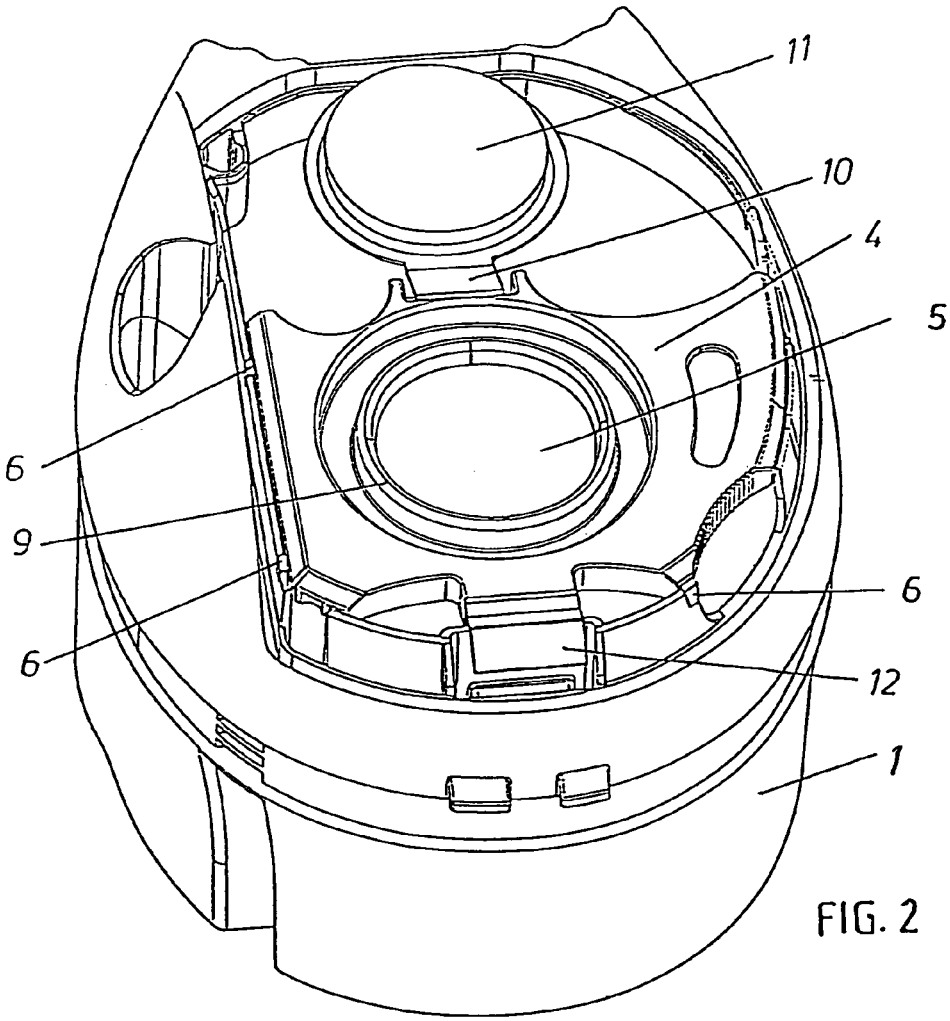
FIG. 2 is a perspective view of a stiffening element of a filter bag arrangement according to a second embodiment of the invention, inserted into a vacuum cleaner housing.

FIG. 2 shows another embodiment of a filter bag arrangement according to the invention, in which the individual mounting elements 6 are configured as hemispheres or half-dome protrusions at the perimeter of the stiffening element 4. These half-dome protrusions are individually insertable into respective allocated receivers 7 in the form of partial spherical notches, recesses, or grooves in the housing 1. It should be understood that other configurations of the individual mounting elements 6 and the corresponding receivers 7 are also possible. It is merely necessary that the configuration of these components allows an, e.g. vertical, insertion of the stiffening element 4 into the vacuum cleaner housing 1 while thereby inserting the mounting elements 6 into the receivers 7 for positioning and fixing the filter bag arrangement 2 in the housing 1.

This filter bag arrangement according to FIG. 2 again includes a closure cap 11 connected to the stiffening element 4 by a pivotable or flexible connecting strap 10 for selectively closing the inlet opening 5, which is further fitted with a seal ring 9, as already described above in connection with the embodiment according to FIG. 1.

Figure 3:
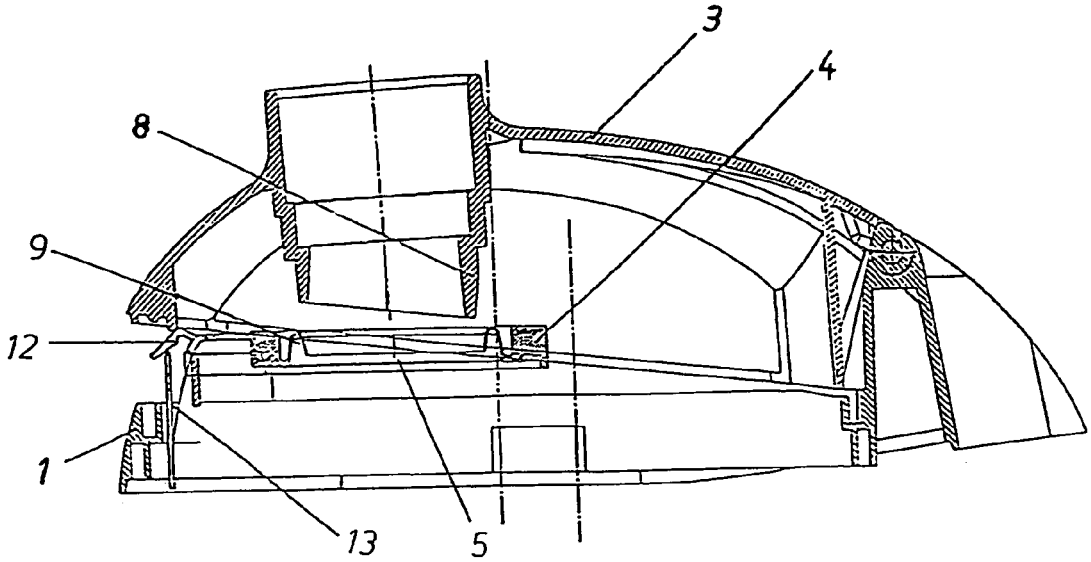
FIG. 3 is a sectional side view of a portion of a filter bag inserted into a vacuum cleaner housing, during a stage of closing the cover or lid of the vacuum cleaner housing.
Figure 4:
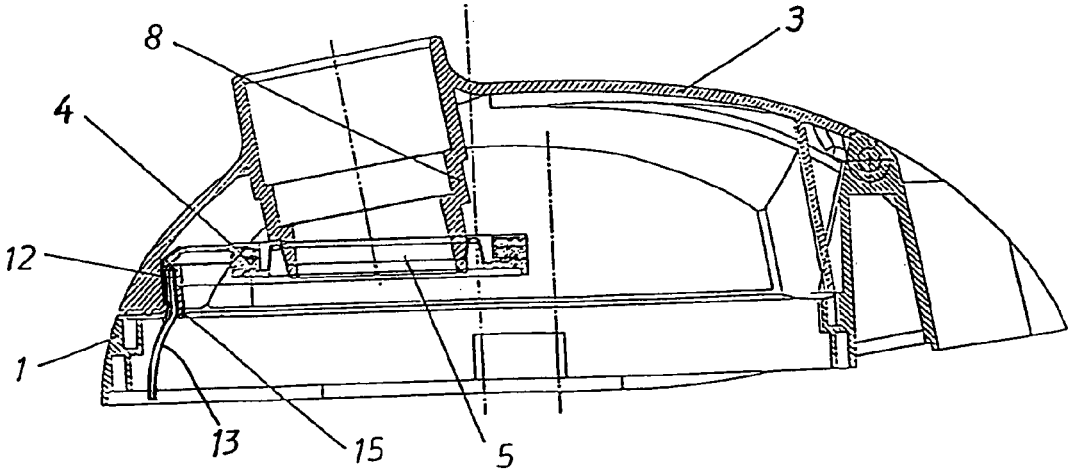
FIG. 4 is a sectional view similar to FIG. 3, but showing the stage with a completely closed vacuum cleaner cover.

Furthermore, the filter bag arrangement shown in FIG. 2 as well as that shown in FIG. 1 includes an outwardly extending latching strap 12 that is flexibly or deflectably connected to the stiffening element 4. As shown in FIGS. 3 and 4, this latching strap 12 serves to secure the filter bag in the vacuum cleaner housing 1, and to hold the filter bag and particularly the stiffening element 4 in position even when the housing lid 3 is opened and tilted upwardly, whereby the filling pipe stub 8 is pulled out of the inlet opening 5 of the stiffening element 4 of the filter bag arrangement. Particularly, when closing the housing lid 3, a portion of the edge rim of the lid 3 presses down and deflects the latching strap 12, so as to deflect the strap 12 downwardly over an upper edge of a securing element 13 that protrudes up from the housing 1. Thereby, the latching strap 12 preferably engages with the securing element 13 and is thus fixedly secured in its downwardly deflected position. In this regard, see the transition from FIG. 3 to FIG. 4.

To achieve this latching engagement of the latching strap 12 with the securing element 13, a particular embodiment of the latching strap 12 includes a latching protrusion, rim, lip, offset or undercut 14 as shown in FIG. 1, for example. This latching protrusion 14 is provided near the radially outer free end of the strap 12 and extends along the free end in a tangential direction. As the latching strap 12 is tilted or deflected downwardly (see the transition from FIG. 3 to FIG. 4), the latching protrusion 14 engages into a corresponding counterpart opening, slot, groove, recess or the like in the securing element 13. Alternatively, the securing element 13 may have a ridge, lip or protrusion that is engaged by an undercut behind the latching protrusion 14 of the latching strap 12.

This engagement between the latching strap 12 and the securing element 13 ensures that the stiffening element 4 will remain fixed in position even when the lid 3 is thereafter opened, whereby the filling pipe stub 8 is pulled out of the inlet opening 5. Then, the inlet opening 5 can be closed with the closure cap 11, and the filter bag arrangement 2 may be removed from the vacuum cleaner housing 1 for disposal and replacement with a new filter bag. It is also possible that the stiffening element 4 is removably connected to the filter bag body of the filter bag arrangement, so that only the filter bag body is removed and discarded, while the stiffening element 4 is used further together with a new filter bag body.

Figure 5:
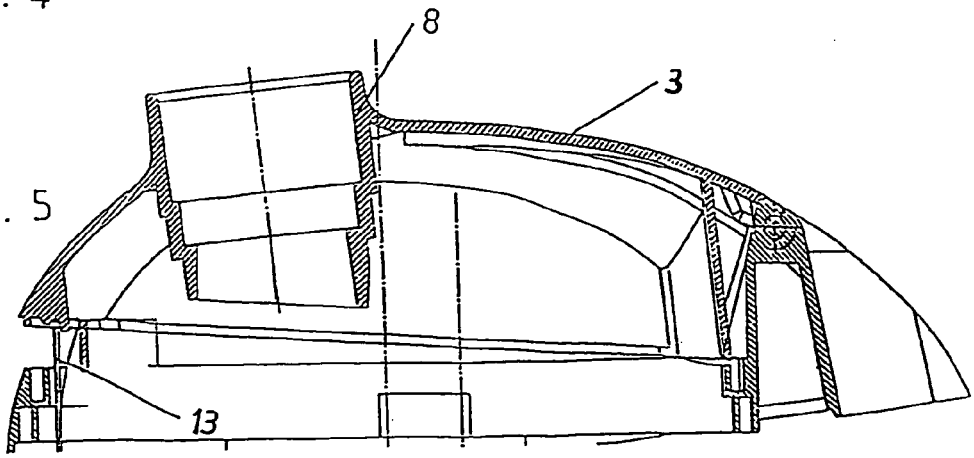
FIG. 5 is a sectional view similar to FIG. 3, but showing the vacuum cleaner housing by itself, without an inserted filter bag.

In the embodiment according to FIGS. 3 to 5, the securing element 13 is flexible or otherwise deflectable by the action of the latching strap 12 being bent or deflected down over the upper edge of the securing element 13 while closing the housing lid 3. Namely, the securing element 13 is thereby flexed or deflected from its initial straight upright condition shown in FIG. 3 to its inwardly flexed condition and position shown in FIG. 4, whereby the upper end of the securing element 13 is then received together with the end of the latching strap 12 in an interspace 15 provided between an inner wall or edge of the rim of the housing lid 3 and an outwardly facing rim or edge of the stiffening element 4.

It should be noted that the latching strap 12 acts as "shoehorn" or deflecting tool that inwardly deflects the securing element 13 as the housing lid 3 is being closed (see the transition from FIG. 3 to FIG. 4). Thus, when no filter bag arrangement 2 is inserted in the housing 1, so there is no latching strap 12 in position over the top edge of the securing element 13, the securing element 13 will act as a blocking obstruction that prevents the complete closing of the housing lid 3, as shown in FIG. 5. Namely, because the latching strap 12 is not interposed in the manner of a "shoehorn" between the edge rim of the lid 3 and the upper edge of the securing element 13 so as to inwardly deflect the securing element 13 into the interspace 15 where it would not interfere with the closing of the lid 3, therefore the outer rim portion of the lid 3 stubs directly against the upper edge of the securing element 13 which prevents closing of the lid 3. Thereby, the user of the vacuum cleaner is given a visual warning (failure of the lid 3 to close) and is prevented from using the vacuum cleaner if no filter bag arrangement 2 is installed in the housing.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims.

What is claimed is:

1. A vacuum cleaner comprising:

a vacuum cleaner housing that defines a bag-receiving chamber therein and that has a plurality of individual bag-positioning receivers fixed in said vacuum cleaner housing;

a bag-securing element connected to said vacuum cleaner housing;

a housing cover movably arranged relative to said vacuum cleaner housing to be selectively movable between a closed position and an open position to respectively close and open said bag-receiving chamber;

a filling pipe stub arranged on said housing cover and having a pipe stub end facing into said bag-receiving chamber; and is a filter bag arrangement that is removably received in said bag-receiving chamber;

wherein:

said filter bag arrangement includes a filter bag body and a filter mounting plate connected to said filter bag body, wherein said filter mounting plate has an inlet opening communicating into said filter bag body, and said filter bag arrangement further includes a latching strap that is permanently connected to and protrudes from said filter mounting plate radially outwardly relative to said inlet opening and that is flexible or is flexibly connected to said filter mounting plate or is pivotably connected to said filter mounting plate, and wherein said latching strap is configured, positioned and arranged to be flexibly deflectable or pivotable toward and into secure engagement with said bag-securing element;

said filter mounting plate, at a perimeter thereof, includes at least three individual protruding mounting elements that are configured, positioned and arranged to be respectively inserted and engaged stationarily into said individual bag-positioning receivers fixed in said vacuum cleaner housing in an insertion direction corresponding to a direction in which said filter bag arrangement is inserted into said bag-receiving chamber, wherein said insertion direction is perpendicular to a plane of said filter mounting plate;

said mounting elements respectively engaged stationarily in said bag-positioning receivers fixedly spatially position said inlet opening of said filter bag arrangement within said bag-receiving chamber;

said filling pipe stub is inserted in said insertion direction and communicates into said inlet opening of said filter bag arrangement at least when said housing cover is in said closed position;

said latching strap of said filter bag arrangement, proximate to a free end thereof, includes a latching element;

said bag-securing element of said vacuum cleaner includes an opening, a recess, a notch, a groove, a rim, or a lip with which said latching element engages to achieve said secure engagement of said latching strap with said bag-securing element;

said housing cover and said latching strap are configured and positioned so that an edge rim portion of said housing cover presses against and thereby flexibly deflects and/or pivots said latching strap toward and into said secure engagement with said bag-securing element as said housing cover is closed to said closed position;

said bag-securing element is flexible and/or is pivotably connected to said vacuum cleaner housing;

said bag-securing element and said latching strap are configured and positioned so that said bag-securing element is flexibly or pivotally deflected from a first position to a second position by said latching strap being squeezed between said edge rim portion of said housing cover and said bag-securing element and thereby said latching strap bears against said bag-securing element as said housing cover is closed to said closed position: and said bag-securing element in said first position blocks and prevents said housing cover from being closed to said closed position, and said bag-securing element must be is deflected from said first position to said second position by said latching strap squeezed between said edge rim portion of said housing cover and said bag-securing element to enable said housing cover to be closed to said closed position so that said housing cover cannot be closed to said closed position if said latching strap is not present or is not properly positioned between said edge rim portion of said housing cover and said bag-securing element.

2. The vacuum cleaner according to claim 1, wherein said filter bag arrangement further comprises a seal ring around a perimeter of said inlet opening to form a seal with respect to said filling pipe stub.

3. The vacuum cleaner according to claim 1, wherein said individual protruding mounting elements are each configured as a radially extending spoke or spider arm, and said filter mounting plate includes exactly four of said individual protruding mounting elements extending radially outwardly around said inlet opening in two diametrically opposed pairs forming an X-configuration.

4. The vacuum cleaner according to claim 1, wherein at least some of said individual protruding mounting elements are each respectively configured as a hemispherical or half-dome protrusion.

5. The vacuum cleaner according to claim 1, wherein each one of said bag-positioning receivers is configured as a partial spherical notch, recess, groove or socket in said vacuum cleaner housing.

6. The vacuum cleaner according to claim 1, wherein said filter bag body is removably and exchangeably connected to said filter mounting plate.

7. The vacuum cleaner according to claim 1, wherein said filter bag arrangement further comprises a closure cap connected by a connecting strap to said filter mounting plate, and wherein said closure cap is configured and adapted to selectively close said inlet opening.

8. The vacuum cleaner according to claim 1, wherein said latching element comprises a latching protrusion that protrudes from said latching strap in a direction away from said housing and toward said filter bag body.

9. The vacuum cleaner according to claim 1, configured and arranged so that said housing cover pivots about a horizontal axis to move between said closed position and said open position, and said filling pipe stub is inserted substantially vertically into said inlet opening, with said plane of said filter mounting plate oriented horizontally as said housing cover is closed to said closed position.

10. A filter bag arrangement for use in a vacuum cleaner including a vacuum cleaner housing that defines a bag-receiving chamber therein and that has a plurality of individual bag-positioning receivers, a bag-securing element connected to said vacuum cleaner housing, a housing cover movably arranged relative to said housing to be selectively movable between a closed position and an open position to respectively close and open said chamber, and a filling pipe stub arranged on said housing cover and having a pipe stub end facing into said chamber;

wherein:

said filter bag arrangement is adapted to be removably received in said chamber and comprises a filter bag body and a filter mounting plate connected to said filter bag body, wherein said filter mounting plate has an inlet opening communicating into said filter bag body, and said filter bag arrangement further includes a latching strap that is permanently connected to and protrudes from said filter mounting plate radially outwardly relative to said inlet opening and that is flexible or is flexibly connected to said filter mounting plate or is pivotably connected to said filter mounting plate, and wherein said latching strap is configured, positioned and arranged to be flexibly deflectable or pivotable toward and into secure engagement with said bag-securing element;

said filter mounting plate, at a perimeter thereof, includes at least three individual protruding mounting elements that are configured, positioned and arranged to be respectively inserted and engaged fixedly into said individual bag-positioning receivers fixed in said vacuum cleaner housing in an insertion direction corresponding to a direction in which said filter bag arrangement is to be inserted into said bag-receiving chamber, wherein said insertion direction is perpendicular to a plane of said filter mounting plate;

said mounting elements respectively are configured and adapted to be engaged stationarily in said bag-positioning receivers of said vacuum cleaner housing so as to thereby fixedly spatially position said inlet opening of said filter bag arrangement within said bag-receiving chamber;

said filter bag arrangement is configured and adapted so that said filling nine stub is to be inserted in said insertion direction and communicate into said inlet opening of said filter bag arrangement at least when said housing cover is in said closed position;

said latching strap of said filter bag arrangement, proximate to a free end thereof, includes a latching element;

said bag-securing element of said vacuum cleaner includes an opening, a recess, a notch, a groove, a rim, or a lip with which said latching element is adapted to engage so as to achieve said secure engagement of said latching strap with said bag-securing element;

said housing cover and said latching strap are configured and positioned so that an edge rim portion of said housing cover is to press against and thereby flexibly deflect and/or pivot said latching strap toward and into said secure engagement with said bag-securing element as said housing cover is closed to said closed position;

said bag-securing element is flexible and/or is pivotably connected to said vacuum cleaner housing;

said bag-securing element and said latching strap are configured and positioned so that said bag-securing element is flexibly or pivotably deflected from a first position to a second position by said latching strap being squeezed between said edge rim portion of said housing cover and said bag-securing element and thereby said latching strap bears against said bag-securing element as said housing cover is closed to said closed position; and said bag-securing element in said first position blocks and prevents said housing cover from being closed to said closed position, and said bag-securing element must be deflected from said first position to said second position by said latching strap squeezed between said edge rim portion of said housing cover and said bag-securing element to enable said housing cover to be closed to said closed position so that said housing cover cannot be closed to said closed position if said latching strap is not present or is not properly positioned between said edge rim portion of said housing cover and said bag-securing element.

11. The filter bag arrangement according to claim 10, further comprising a seal ring around a perimeter of said inlet opening to form a seal with respect to said filling pipe stub.

12. The filter bag arrangement according to claim 10, wherein said individual protruding mounting elements are each configured as a radially extending spoke or spider arm, and said filter mounting plate includes exactly four of said individual protruding mounting elements extending radially outwardly around said inlet opening in two diametrically opposed pairs forming an X-configuration.

13. The filter bag arrangement according to claim 10, wherein at least some of said individual protruding mounting elements are each respectively configured as a hemispherical or half-dome protrusion.

14. The filter bag arrangement according to claim 10, wherein said filter bag body is removably and exchangeably connected to said filter mounting plate.

15. The filter bag arrangement according to claim 10, further comprising a closure cap connected by a connecting strap to said filter mounting plate, and wherein said closure cap is configured and adapted to selectively close said inlet opening.

16. The filter bag arrangement according to claim 10, wherein said latching element comprises a latching protrusion that protrudes from said latching strap in a direction away from said housing and toward said filter bag body when said filter bag arrangement is arranged in said bag-receiving chamber.

17. The vacuum cleaner according to claim 1, wherein said vacuum cleaner housing and said filter bag arrangement are configured and arranged so that said insertion direction is a vertical insertion direction, and said plane of said filter mounting plate extends horizontally when said mounting elements are engaged in said bag-positioning receivers.

18. The vacuum cleaner according to claim 1, wherein said latching element of said latching strap, once engaged with said opening, said recess, said notch, said groove, said rim or said lip of said bag-securing element in said secure engagement, remains securely engaged and holds said filter bag arrangement in said bag-receiving chamber until being manually disengaged and removed.

19. A combination of a vacuum cleaner and a filter bag arrangement, wherein:

said vacuum cleaner includes a housing that defines a bag-receiving chamber therein, a cover that is pivotally connected to said housing so as to be pivobable between an open position in which said bag-receiving chamber is open and a closed position in which said cover closes said bag-receiving chamber, and a flexible bag-securing element that protrudes from said housing in said bag-receiving chamber toward an edge rim portion of said housing cover when said bag-securing element is in an un-stressed un-deflected position, such that said bag-securing element is aligned with said edge rim portion of said housing cover and thereby blocks said edge rim portion and prevents said housing cover from pivoting to said closed position when said bag-securing element is in said un-stressed un-deflected position;

said filter bag arrangement comprises a dust-collecting filter bag, a filter bag mounting plate connected to said filter bag, and a latching strap (12) that is permanently connected to and protrudes from said filter bag mounting plate;

wherein:

said latching strap is flexibly deflectable between an unlatched position and a latched position;

with said filter bag arrangement arranged in said bag-receiving chamber of said housing, said latching strap is configured and arranged to protrude in said unlatched position from said bag mounting plate so that said latching strap is positioned between and contacted by both said edge rim portion of said housing cover and said bag-securing element in said un-stressed un-deflected position, and so that as said housing cover is pivoted from said open position to said closed position said edge rim portion pushes and deflects said latching strap from said unlatched position to said latched position and thereby said latching strap pushes and deflects said bag-securing element from said un-stressed un-deflected position to a stressed deflected position in which said bag-securing element does not block said edge rim portion and does not prevent said housing cover from pivoting to said closed position; and an inwardly facing surface of said latching strap and an outwardly facing surface of said bag-securing element respectively have mutually interengaging latch elements that engage with one another so as to interengage and hold said latching strap in said latched position and said bag-securing element in said stressed deflected position.

20. A method of using the combination according to claim 19, comprising installing said filter bag arrangement in said vacuum cleaner according to the following steps:

a) pivoting said housing cover to said open position;

b) arranging said filter bag arrangement in said bag-receiving chamber with said latching strap protruding from said filter bag mounting plate out over and contacting said bag-securing element; and c) pivoting said housing cover from said open position to said closed position, such that said edge rim portion contacts and pushes said latching strap against said bag-securing element so as to deflect said latching strap from said unlatched position to said latched position and thereby said latching strap deflects said bag-securing element from said un-stressed un-deflected position to said stressed deflected positions and said latch elements engage with one another.

* * * * *

UNITED STATES PATENT AND TRADEMARK OFFICE

CERTIFICATE OF CORRECTION

PATENT NO. : 7,637,975 B2
APPLICATION NO. : 11/234501
DATED : December 29, 2009
INVENTOR(S) : Stein et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 773 days.

Signed and Sealed this

Ninth Day of November, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,637,975 B2
APPLICATION NO. : 11/234501
DATED : December 29, 2009
INVENTOR(S) : Stein et al.

It is certified that error appears in the above-identified patent and that said Letters Patent is hereby corrected as shown below:

Column 6,
Line 16, before “a filter”, delete “is”;

Column 7,
Line 5, after “position”, replace “:” by --;--;
Line 9, before “deflected”, delete “is”;
Line 56, after “horizontally”, insert --,--;

Column 8,
Line 33, after “filling”, replace “nine” by --pipe--;
Line 54, after “or”, replace “pivotably” by --pivotally--;

Column 9,
Line 49, after “be”, replace “pivobable” by --pivotable--;

Column 10,
Line 9, after “strap”, delete “(12)”;
Line 53, after “deflected”, replace “positions” by --position--.

Signed and Sealed this
Eighth Day of February, 2011

David J. Kappos

David J. Kappos
*Director of the United States Patent and Trademark Office*